US008857917B2

(12) United States Patent
Bookhamer et al.

(10) Patent No.: US 8,857,917 B2
(45) Date of Patent: Oct. 14, 2014

(54) CUTTING TOOL MOUNTING ASSEMBLY

(71) Applicant: Kennametal Inc., Latrobe, PA (US)

(72) Inventors: Paul A. Bookhamer, Altoona, PA (US); Nicholas J. Paros, Johnstown, PA (US); Luke A. Weber, Hollidaysburg, PA (US)

(73) Assignee: Kennametal Inc., Latrobe, PA (US)

( * ) Notice: Subject to any disclaimer, the term of this patent is extended or adjusted under 35 U.S.C. 154(b) by 56 days.

(21) Appl. No.: 13/711,981

(22) Filed: Dec. 12, 2012

(65) Prior Publication Data

US 2014/0159467 A1 Jun. 12, 2014

(51) Int. Cl.
*E21C 35/19* (2006.01)

(52) U.S. Cl.
CPC ..... *E21C 35/19* (2013.01)
USPC ..... 299/102

(58) Field of Classification Search
USPC ..... 299/102, 106
See application file for complete search history.

(56) References Cited

U.S. PATENT DOCUMENTS

| | | | | |
|---|---|---|---|---|
| 3,397,012 | A * | 8/1968 | Krekeler | 299/104 |
| 4,275,929 | A * | 6/1981 | Krekeler | 299/102 |
| 4,343,516 | A * | 8/1982 | Aden | 299/106 |
| 4,542,943 | A * | 9/1985 | Montgomery, Jr. | 299/102 |
| 4,621,871 | A * | 11/1986 | Salani | 299/107 |
| 4,693,518 | A | 9/1987 | Sulosky et al. | |
| 4,915,455 | A | 4/1990 | O'Neill et al. | |
| 5,005,622 | A | 4/1991 | Beach et al. | |
| 6,220,671 | B1 | 4/2001 | Montgomery, Jr. | |
| 6,234,579 | B1 | 5/2001 | Montgomery, Jr. | |
| 6,481,803 | B2 | 11/2002 | Ritchey | |
| 6,854,810 | B2 | 2/2005 | Montgomery, Jr. | |
| 7,210,744 | B2 | 5/2007 | Montgomery, Jr. | |
| 7,461,903 | B2 | 12/2008 | Tewes et al. | |
| D638,453 | S | 5/2011 | Buhr et al. | |
| 2011/0089746 | A1 | 4/2011 | Helsel et al. | |
| 2011/0148178 | A1 | 6/2011 | Lehnert et al. | |
| 2011/0148179 | A1 | 6/2011 | Lehnert et al. | |
| 2011/0266860 | A1 | 11/2011 | Charlton | |

OTHER PUBLICATIONS

Kennametal Inc., "Road Rehabilitation, Advanced cutting and wear solutions to improve the roads we travel.", Catalog, 4 pages(cover, pp. 15-16, back cover), 2007.

* cited by examiner

*Primary Examiner* — John Kreck
(74) *Attorney, Agent, or Firm* — Matthew W. Smith, Esq.

(57) ABSTRACT

A cutting tool mounting assembly adapted for attachment to a surface of a rotatable driving member of a cutting tool machine. The cutting tool mounting assembly includes a tool holder having a key shank, a base attached to the surface of the rotatable driving member with the base having a mounting groove for receiving the key shank of the tool holder, and a resilient retention structure configured to interact with the base and the tool holder to facilitate a friction fit between the tool holder and the base.

10 Claims, 5 Drawing Sheets

CUTTING TOOL MOUNTING ASSEMBLY

BACKGROUND OF THE INVENTION

The invention pertains generally to a cutting tool mounting assembly that is useful in association with machines for impinging a substrate or earth strata such as, for example, asphaltic roadway material, coal deposits, mineral formations and the like. More particularly, the invention pertains to a cutting tool mounting assembly, as well as the individual components of the assembly.

One typically uses such an assembly in conjunction with a rotatable drum or driven member. The driven member rotates in such a fashion to drive the rotatable cutting bit or tool into earth strata to disintegrate the same into smaller pieces including fine particulates, i.e., cutting debris. The cutting bit or tool, the tool holder and the base are each subjected to considerable stresses during mining operations, road milling operations or other like operations that can lead to wear and/or failure of one or more of the cutting tool assembly components. One source of wear occurs as a result of the mounting between the tool holder and the base. Accordingly, there is a desire to mount the tool holder in the base so as to minimize movement of the tool holder in order to maximize the useful life of all the components of the cutting tool assembly. It is also important that the mounting between the cutting bit holder and the support block be resistant to vibratory loosening which could likewise lead to premature wear and/or failure of one or more of the cutting tool assembly components.

Nonetheless, due to operation of such cutting tool assemblies in severe operating conditions wear and/or failure will occur. This type of damage can make it very difficult to disassemble the cutting tool assembly components and replace the components that are damaged. It will be appreciated that it is an advantage to be able to disassemble the cutting tool assembly components, such as the tool holder from the base as needed.

Thus, it can be appreciated that cutting tool assemblies can experience wear and/or failure in a number of ways due to the environment in which they operate and must be frequently replaced. It would thus be highly desirable to provide an improved cutting tool assembly that experiences an increase in useful tool life as compared to heretofore known cutting tool assemblies.

In addition, it would be highly desirable to provide a cutting tool assembly having, in one aspect, a tool holder-base assembly configured to provide a desired mounting or fit therebetween while facilitating a relatively easy disassembly of the tool holder from the base portion of the cutting tool assembly.

SUMMARY OF THE INVENTION

In accordance with an aspect of the invention, a cutting tool mounting assembly adapted for attachment to a surface of a rotatable driving member of a cutting tool machine, the cutting tool mounting assembly including: a tool holder having a key shank; a base attached to the surface of the rotatable driving member, the base having a mounting groove for receiving the key shank of the tool holder; and a resilient retention structure configured to interact with the base and the tool holder to facilitate a friction fit between the tool holder and the base. In one aspect, the tool holder is releasably attached to the base. In another aspect, the resilient retention structure is a compressible member positioned between the base and the tool holder. In yet another aspect, the resilient retention structure is a spring clip positioned between the base and the tool holder.

In accordance with another aspect of the invention, a cutting tool mounting assembly adapted for attachment to a surface of a rotatable driving member of a cutting tool machine, the cutting tool mounting assembly including: a tool holder having a key shank; a base attached to the surface of the rotatable driving member, the base having a mounting groove for receiving the key shank of the tool holder; and a compressible member configured to interact with the base and the tool holder to facilitate a friction fit between the tool holder and the base. In one aspect, the mounting groove includes a recess configured for receiving a bottom portion of the compressible member and a bottom surface of the key shank includes a notch configured for receiving a top portion of the compressible member.

In accordance with yet another aspect of the invention, a cutting tool mounting assembly adapted for attachment to a surface of a rotatable driving member of a cutting tool machine, the cutting tool mounting assembly including: a tool holder having a key shank; a base attached to the surface of the rotatable driving member, the base having a mounting groove for receiving the key shank of the tool holder; and a spring clip configured to interact with the base and the tool holder to facilitate a friction fit between the tool holder and the base. In one aspect, the mounting groove includes a recess configured for receiving a bottom portion of the spring clip and a bottom surface of the key shank includes a notch configured for receiving a top portion of the spring clip.

These and other aspects of the present invention will be more fully understood following a review of this specification and drawings.

DETAILED DESCRIPTION

Figure 1:
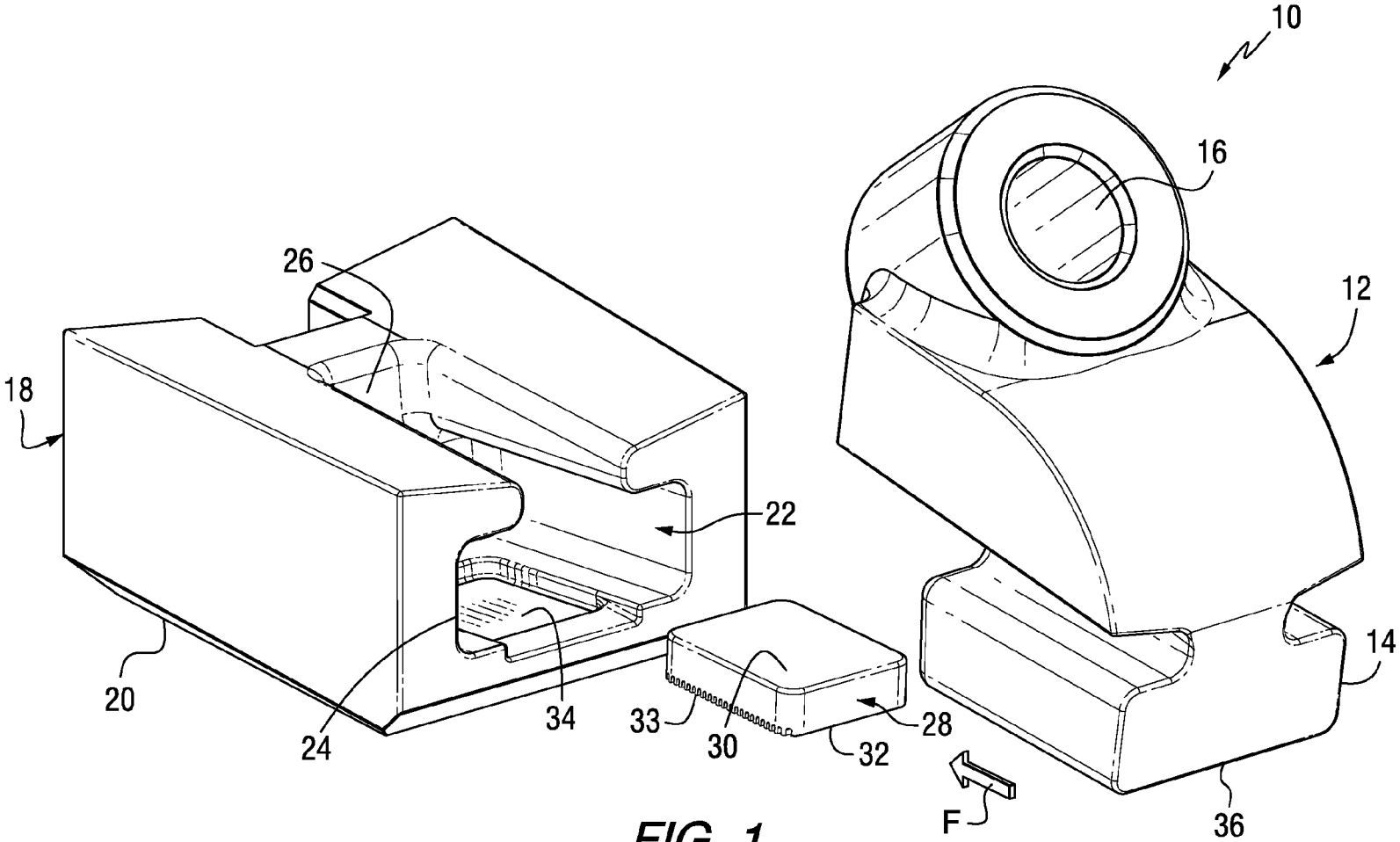
FIG. 1 is an exploded perspective view of a cutting tool mounting assembly, in accordance with an aspect of the invention.
Figure 2:
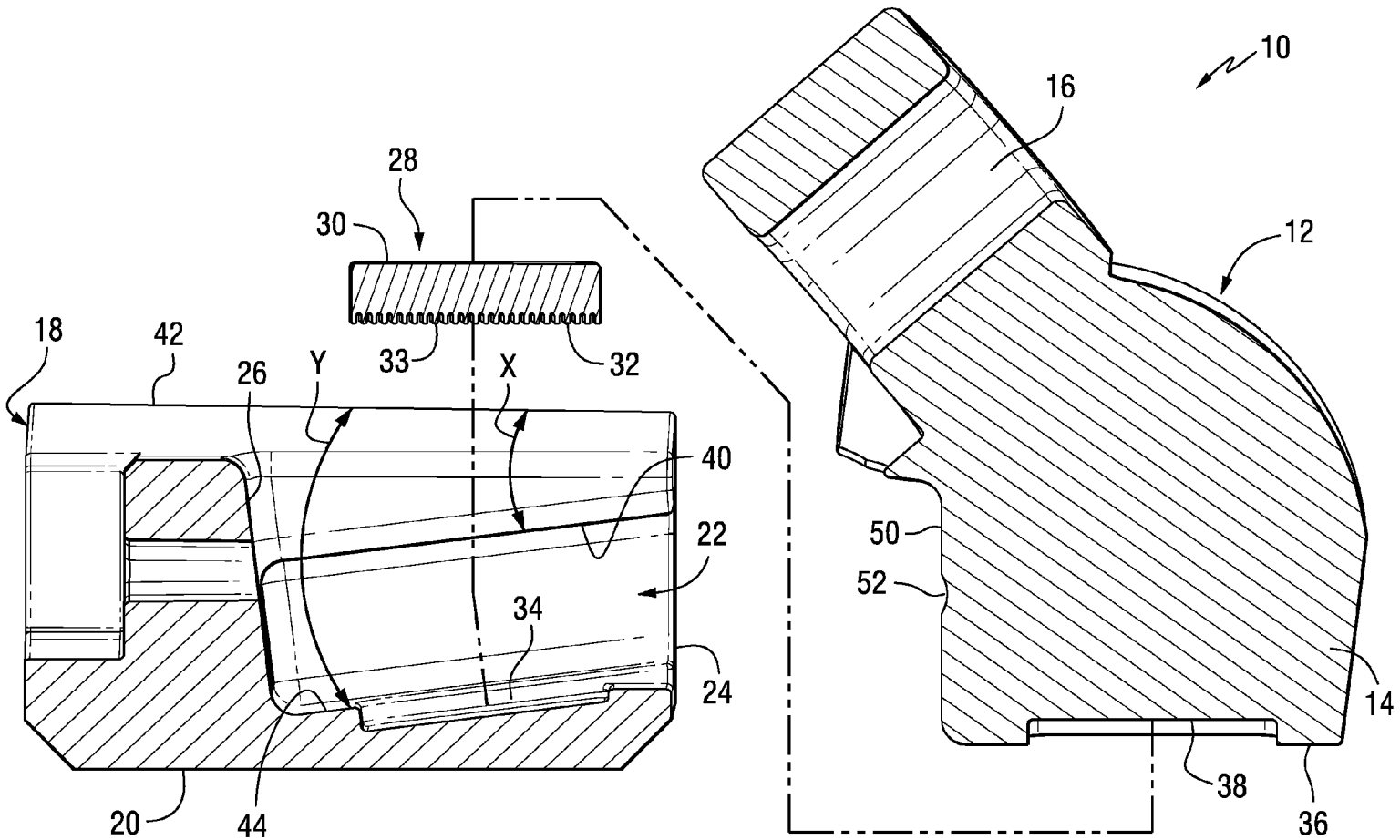
FIG. 2 is an exploded sectional view of the cutting tool mounting assembly illustrated in FIG. 1, in accordance with an aspect of the invention.
Figure 4:
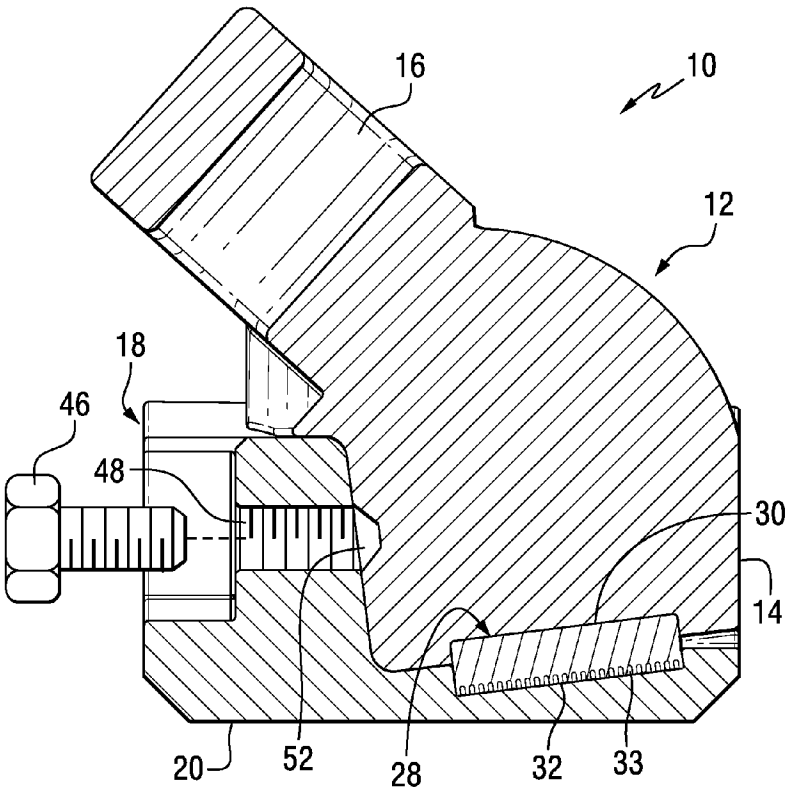
FIG. 4 is a sectional view of FIG. 3 taken along line A-A, in accordance with an aspect of the invention.
Figure 3:
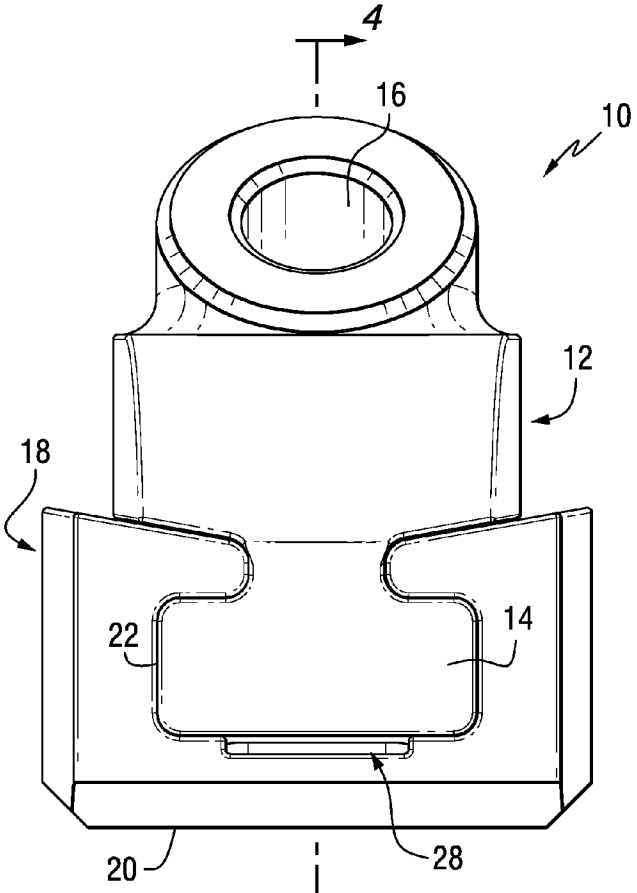
FIG. 3 is a front view of the cutting tool mounting assembly illustrated in FIG. 1 as assembled, in accordance with an aspect of the invention.

The following description is for purposes of illustrating various aspects of the invention only and not for purposes of limiting the scope of the invention.

Referring to the Figures, there is illustrated a cutting tool mounting assembly, generally designated as reference number 10, in accordance with various aspects of the invention. It will be appreciated that the invention has application to various kinds of cutting tools useful in various kinds of cutting operations. Exemplary operations include, without limitation, road planing (or milling), coal mining, concrete cutting, and other kinds of cutting operations wherein a cutting tool with a hard cutting member impinges against a substrate (e.g., earth strata, pavement, asphaltic highway material, concrete, and the like) breaking the substrate into pieces of a variety of sizes including larger-size pieces or chunks and smaller-sized pieces including dust-like particles. In addition, it will be appreciated that the cutting tool mounting assembly 10 of the invention may be manufactured in various sizes and dimensions depending upon the desired application of the assembly.

Referring to FIGS. 1-4, there is illustrated in detail the cutting tool mounting assembly 10 of the invention. The cutting tool mounting assembly 10 is adapted for attachment to a surface of a rotatable driving member of a cutting machine (not shown) such as, for example, a mining machine. The cutting tool mounting assembly 10 is attached or connected to the rotatable driving member such as, for example, a rotating drum by methods well known in the art such as, for example, welding. The cutting tool mounting assembly 10 is configured for mounting or receiving a rotatable cutting tool with a hard cutting member (not shown) for impinging against a substrate, e.g., earth strata, pavement, asphaltic highway material, concrete, and the like as is also well known in the art.

The cutting tool mounting assembly 10 includes a tool holder 12 having a key shank 14 and a cylindrical opening 16 for mounting or receiving a rotatable cutting tool with a hard cutting member. The cutting tool mounting assembly 10 further includes a base 18 having a bottom 20 for attaching to a surface of a rotatable driving member. The base 18 includes a mounting groove 22 structured and arranged for cooperating with the key shank 14 of the tool holder 12. In one aspect, the key shank 14 has a generally T-shaped configuration and the mounting groove 14 also has a generally T-shaped configuration for receiving the key shank 14.

In another aspect, the tool holder 12 and the base 18 are structured and arranged such that the tool holder 12 is releasably attachable to the base 18 so that the tool holder 12 can be quickly and easily removed and replaced due to routine wear or failure of the tool holder 12. In order to provide the desired quick and easy removal and replacement of the tool holder 12, in one aspect of the invention the cutting tool mounting assembly 10 includes a resilient retention structure (as will be explained in detail herein) that is configured to interact or cooperate with the tool holder 12 and the base 18 to facilitate or provide a friction or interference fit between the tool holder 12 and the base 18. Advantageously, the resilient retention structure configuration by providing a friction or interference fit between the tool holder 12 and the base 18 provides an adequate or sufficient connection or attachment between the tool holder 12 and the base 18 so as to prevent the tool holder 12 from becoming disconnected from the base 18 when installed therein and/or during a cutting operation. For example, when the tool holder 12 is initially installed in the base 18 and the assembly 10 is at rest, i.e. no cutting operation is being performed, then the friction or interference fit provided by the resilient retention structure configuration sufficiently provides a connection therebetween so as to prevent the tool holder 12 from disconnecting from the base 18.

Furthermore, when the cutting tool carried by the cutting tool mounting assembly 10 impacts a substrate during a cutting operation the forces generated by the impact cause the tool holder 12 to be continually pushed or forced inward into the base 18 in the direction shown by arrow F (see FIG. 1) through the front or forward open end 24 of the base 18 toward a back or rearward end 26 of the base 18 thereby maintaining the tool holder 12 connected to the base 18. Thus, it will be appreciated that the resilient retention structure configuration of the invention provides for the tool holder 12 to remain adequately connected to the base 18 while still allowing for the desired quick and easy removal and replacement of the tool holder 12 from the base 18 without the need for a rigid or locking connection between the tool holder 12 and the base 18 as is typical in known prior art cutting tool mounting assemblies.

Referring to FIGS. 1-4, in one aspect of the invention the described resilient retention structure includes a compressible member 28 positioned between the base 18 and the tool holder 12 to provide the friction or interference fit between the tool holder 12 and the base 18. The compressible member 28 includes a top portion 30 and a bottom portion 32. In one aspect, the mounting groove 22 defines or includes a recess 34 formed in a bottom surface 44 of the mounting groove 22 configured for receiving the bottom portion 32 of the compressible member 28. In another aspect, a bottom surface 36 of the key shank 14 defines or includes a pocket or notch 38 configured for receiving the top portion 30 of the compressible member 28. Thus, it will be appreciated that the compressible member 28 is positioned between the bottom surface 36 of the tool holder 12 and bottom surface 44 of the mounting groove 22.

The compressible member 28 may be formed of, for example, nylon, neoprene, polyurethane, rubber or like materials having sufficient compressibility.

The cutting tool mounting assembly 10 is assembled by first installing the compressible member 28 in notch 38 of the tool holder 12. In one aspect, the compressible member 28 is mated to the tool holder 12 with the top portion 30 facing the notch 38 and is held secure therein by, for example, interference fit or glue between the top surface 30 of the compressible member 28 and notch 38. After the tool holder 12 is assembled with the compressible member 28 secured in the notch 38, the tool holder 12 is then positioned into the groove 22 of the base 18. A force is then applied to the tool holder 12 with, for example, a rubber mallet until the compressible member 28 becomes mated with the recess 34 formed in the mounting groove 22. In another aspect, the compressible member 28 includes a serrated portion 33 formed on at least a part of the bottom portion 32. The serrated portion 33 of the compressible member 28 reduces the amount of friction between the compressible member 28 and the base 18 during the tool holder 12 installation allowing for minimal impact force needing to be applied to the tool holder 12 during assembly mating with base 18. This configuration of the compressible member 28 contributes to its resiliency and, thus, provides a resilient retention structure in accordance with aspects of the invention.

In another aspect of the invention, the mounting groove 22 of the base 18 slopes generally downwardly from the open forward end 24 to the rearward end 26. For example, a top edge or surface 40 of the mounting groove 22 may be at an angle X in the range of about 4 degrees to about 10 degrees from a top 42 of the base 18, and in one aspect may be at an angle X in the range of about 6 degrees to about 8 degrees from a top 42 of the base 18. Also for example, the bottom edge or surface 44 of the mounting groove 22 may be at an angle Y in the range of about 4 degrees to about 10 degrees from a top 42 of the base 18, and in one aspect may be at an angle Y in the range of about 6 degrees to about 8 degrees from a top 42 of the base 18. Advantageously, this sloped configuration of the mounting groove further aids in providing an adequate or sufficient connection or attachment between the tool holder 12 and the base 18 so as to prevent the tool holder 12 from becoming disconnected from the base 18 when installed therein and/or during a cutting operation.

In another aspect of the invention, the tool holder 12 may be removed or disconnected from the base 18 by, for example, by inserting a bolt 46 into a threaded aperture 48 in the rearward portion of the base 18 such that the bolt 46 contacts a back surface 50 of the base 18. More particularly, the back surface 50 of the tool holder 12 may include a dimple 52 axially aligned with the aperture 48 such that the bolt 46 may be seated directly in the back surface 50 to provide firm contact between the bolt 46 and the tool holder 12. In one aspect, the tool holder 12 is removed from the base 18 by rotating bolt 46 in a clockwise direction until bolt 46 comes in contact with the dimple 52 located on the back surface of 50. As the bolt 46 presses against the back surface 50, the tool holder 12 will begin to exit the base 18 via the mounting groove 22. The compressible member 28 serrated portion 33 features will advantageously collapse or compress sufficiently during the tool holder 12 extraction, thus disassembling the tool holder 12 from the base 18.

Figure 5:
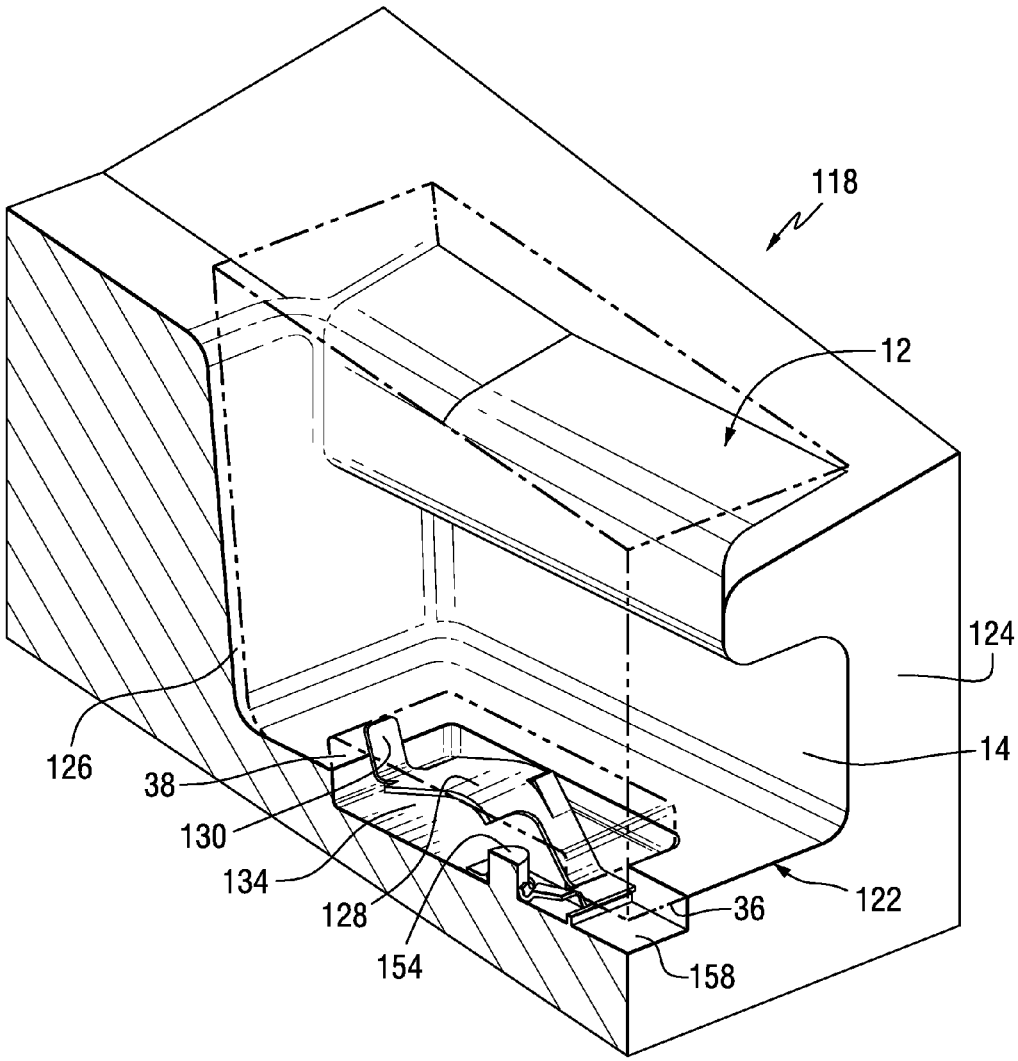
FIG. 5 is a perspective sectional view of a base of an additional cutting tool mounting assembly, in accordance with another aspect of the invention.
Figure 6:
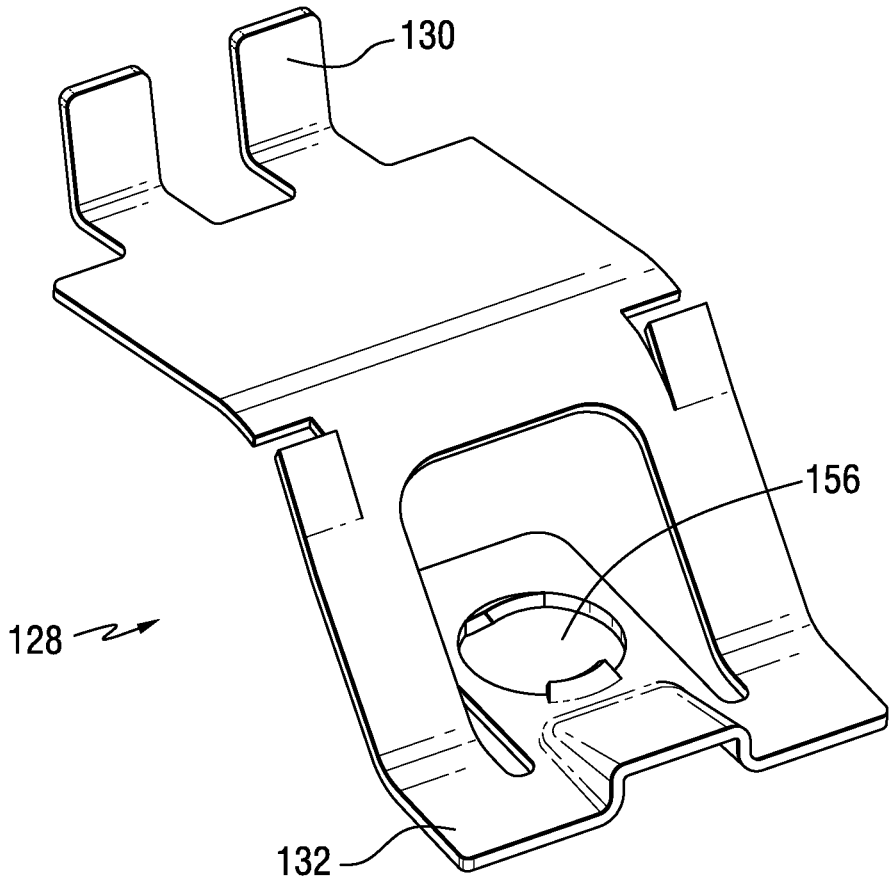
FIG. 6 is a perspective view of a spring clip illustrated in FIG. 5, in accordance with another aspect of the invention

Referring to FIGS. 5 and 6, there is illustrated an alternative base 118 and resilient retention structure for providing a friction or interference fit between the tool holder 12 (shown partially and in phantom line in FIG. 5) and the base 118. In one aspect, the resilient retention structure includes a spring clip 128 structured and arranged to be positioned between the base 118 and the tool holder 12 to provide the desired friction or interference fit between the tool holder 12 and the base 118. The spring clip 128 includes a top portion 130 for cooperating with the notch 38 in the bottom surface 36 of the key shank 14 and a bottom portion 132 for cooperating with a recess 134 formed in the mounting groove 122. In one aspect, the recess 134 includes means for securing the bottom portion 132 of the spring clip 128 in the recess 134 such as, for example, a cylindrical boss 154 formed in the recess 134 for cooperating with an aperture 156 formed in the bottom portion 132 of the spring clip 128.

The spring clip 128 may be made of, for example, C1050, C1060, C1070 spring steel or like materials.

In one aspect, the spring clip 128 is installed in the recess 134 which is formed in the mounting groove 122 and held in place using a friction or interference fit between the cylindrical boss 154 and the spring clip aperture 156. The tool holder 12 is then positioned into the base 118 mounting groove 122 by applying a force to the tool holder 12 with, for example, a rubber mallet causing a compression to the spring clip 128 until the top portion 130 of the spring clip 128 becomes mated with the notch 38 located on the bottom surface 36 of the key shank 14. The high yield strength of the spring clip 128 material will allow for the spring clip 128 to expand back to its original shape producing a locking friction force between the tool holder 12 and the base 118. This configuration of the spring clip 128 contributes to its resiliency and, thus, provides a resilient retention structure in accordance with aspects of the invention.

In another aspect of the invention, the base 118 includes a slot 158 formed in a forward end of the base 118 such that the slot 158 is in communication with the recess 134 to assist in the tool holder 12 being removed or disconnected from the base 118. In one aspect, removing the tool holder 12 from the base 118 involves, for example, inserting a flat tipped tool such as a screwdriver or chisel into slot 158 producing a wedge between the spring clip 128 and the bottom surface 36 of the key shank 14. This action will disengage the spring clip 128 top portion 130 from the notch 38 located on the bottom surface 36 of the tool holder 12. The tool holder 12 is then removed from the base 118 by rotating bolt 46 in a clockwise direction until bolt 46 comes in contact with the dimple 52 located on the back surface 50. As the bolt 46 presses against the back surface 50, the tool holder 12 will begin to exit the base 118.

In another aspect of the invention, the mounting groove 122 of the base 118 slopes generally downwardly from the open forward end 124 to the rearward end 126 similar to as described herein for base 18. Advantageously, this sloped configuration of the mounting groove in combination with the spring clip 128 provides an adequate or sufficient connection or attachment between the tool holder 12 and the base 118 so as to prevent the tool holder 12 from becoming disconnected from the base 118 when installed therein and/or during a cutting operation.

Whereas particular aspects of this invention have been described above for purposes of illustration, it will be evident to those skilled in the art that numerous variations of the details of the present invention may be made without departing from the invention as defined in the appended claims. For example, various shapes, sizes or configurations of the compressible member 28 or the spring clip 128 may be provided for providing a friction or interference fit between the tool holder 12 and the base 18 or base 118.

What is claimed is:

1. A cutting tool mounting assembly adapted for attachment to a surface of a rotatable driving member of a cutting tool machine, the cutting tool mounting assembly comprising:

a tool holder having a key shank;

a base attached to the surface of the rotatable driving member, the base having a mounting groove for receiving the key shank of the tool holder, wherein the mounting groove of the base includes an open end for receiving the key shank and an opposing rearward end and the mounting groove slopes generally downwardly from the open end of the rearward end; and a resilient retention structure configured to interact with the base and the tool holder to facilitate a friction fit between the tool holder and the base, wherein the mounting groove includes a recess configure for receiving a bottom portion of the resilient retention structure, wherein a bottom surface of the key shank includes a notch configured for receiving a top portion of the resilient retention structure.

2. The cutting tool mounting assembly of claim 1, wherein the key shank is generally T-shaped.

3. The cutting tool mounting assembly of claim 2, wherein the mounting groove is generally T-shaped for cooperating with the key shank.

4. The cutting tool mounting assembly of claim 1, wherein the tool holder is releasably attached to the base.

5. The cutting tool mounting assembly of claim 1, wherein the resilient retention structure includes a compressible member positioned between the base and the tool holder.

6. The cutting tool mounting assembly of claim 5, wherein the compressible member is formed of nylon, neoprene, polyurethane or rubber.

7. The cutting tool mounting assembly of claim 1, wherein the resilient retention structure includes a spring clip positioned between the base and the tool holder.

8. A cutting tool mounting assembly adapted for attachment to a surface of a rotatable driving member of a cutting tool machine, the cutting tool mounting assembly comprising:

a tool holder having a key shank;

a base attached to the surface of the rotatable driving member, the base having a mounting groove for receiving the key shank of the tool holder, wherein the mounting groove of the base includes an open end for receiving the key shank and an opposing rearward end and the mounting groove slopes generally downwardly from the open end of the rearward end; and a compressible member configured to interact with the base and the tool holder to facilitate a friction fit between the tool holder and the base, wherein the mounting groove includes a recess configured for receiving a bottom portion of the compressible member wherein a bottom surface of the key shank includes a notch configured for receiving a top portion of the compressible member.

9. The cutting tool mounting assembly of claim 8, wherein the compressible member is formed of nylon, neoprene, polyurethane or rubber.

10. A cutting tool mounting assembly adapted for attachment to a surface of a rotatable driving member of a cutting tool machine, the cutting tool mounting assembly comprising:

a tool holder having a key shank;

a base attached to the surface of the rotatable driving member, the base having a mounting groove for receiving the key shank of the tool holder, wherein the mounting groove of the base includes an open end for receiving the key shank and an opposing rearward end and the mounting groove slopes generally downwardly from the open end of the rearward end; and a spring clip configured to interact with the base and the tool holder to facilitate a friction fit between the tool holder and the base, wherein the mounting groove includes a recess configured for receiving a bottom portion of the spring clip, wherein a bottom surface of the key shank includes a notch configured for receiving a top portion of the spring clip.

* * * * *

UNITED STATES PATENT AND TRADEMARK OFFICE

CERTIFICATE OF CORRECTION

PATENT NO. : 8,857,917 B2
APPLICATION NO. : 13/711981
DATED : October 14, 2014
INVENTOR(S) : Bookhamer et al.

It is certified that error appears in the above-identified patent and that said Letters Patent is hereby corrected as shown below:

IN THE CLAIMS

In Column 6, Line 32, in Claim 1, delete “of the” and insert -- to the --, therefor.

In Column 6, Line 36, in Claim 1, delete “configure” and insert -- configured --, therefor.

In Column 7, Line 2, in Claim 8, delete “of the” and insert -- to the --, therefor.

In Column 8, Line 8, in Claim 10, delete “of the” and insert -- to the --, therefor.

Signed and Sealed this
Seventh Day of April, 2015

Michelle K. Lee

Michelle K. Lee
*Director of the United States Patent and Trademark Office*